US005301644A

United States Patent [19]

Olmr

[11] Patent Number: 5,301,644

[45] Date of Patent: Apr. 12, 1994

[54] FUEL SHUT-OFF MECHANISM FOR INTERNAL COMBUSTION ENGINES

[75] Inventor: Jaroslav J. Olmr, Sheboygan, Wis.

[73] Assignee: Kohler Co., Kohler, Wash.

[21] Appl. No.: 78,526

[22] Filed: Jun. 16, 1993

[51] Int. Cl.[5] ..... F02B 77/00

[52] U.S. Cl. ..... 123/198 DB; 123/DIG. 11

[58] Field of Search ..... 123/DIG. 11, 198 DB

[56] References Cited

U.S. PATENT DOCUMENTS

| | | | |
|---|---|---|---|
| Re. 32,030 | 11/1985 | Yano et al. | 364/431.04 |
| 3,146,769 | 9/1964 | Hall | 123/140 |
| 3,191,585 | 6/1965 | Craft | 123/198 DB |
| 3,738,346 | 6/1973 | Goodman | 123/198 DB |
| 3,993,038 | 11/1976 | Alt et al. | 123/198 DB |
| 3,996,908 | 12/1976 | Brown, III et al. | 123/124 B |
| 4,083,346 | 4/1978 | Eheim | 123/139 BD |
| 4,231,345 | 11/1980 | Drews et al. | 123/510 |
| 4,237,926 | 12/1980 | Walker | 137/565 |
| 4,328,547 | 5/1982 | Barman et al. | 364/431.09 |
| 4,577,597 | 3/1986 | Tomita | 123/73 A |
| 4,976,234 | 12/1990 | Okuda | 123/198 DC |
| 4,995,355 | 2/1991 | Cowley | 123/198 DB |
| 4,996,644 | 2/1991 | Fukuchi et al. | 364/431.05 |

*Primary Examiner*—Noah P. Kamen

*Attorney, Agent, or Firm*—Quarles & Brady

[57] ABSTRACT

An engine has a carburetor that includes a bowl for fuel, a venturi in which the fuel is mixed with air, and a tube for carrying fuel from the bowl to the venturi. A solenoid valve is connected to the tube to control the flow of fuel to the venturi. An engine ignition system includes a coil assembly in which electricity is generated by a permanent magnet driven by the engine passing hear the coil assembly. A transformer includes a primary winding connected to the coil assembly, and a secondary winding. A storage capacitor and a diode are coupled in series across the secondary winding and a switch couples the solenoid valve to said storage capacitor. When an operator desires to stop the engine, the switch is closed which applies electricity from the capacitor to the solenoid valve to reduce an amount of fuel flowing through the tube.

8 Claims, 2 Drawing Sheets

FUEL SHUT-OFF MECHANISM FOR INTERNAL COMBUSTION ENGINES

BACKGROUND OF THE INVENTION

The present invention relates to internal combustion engines and more particularly to mechanisms for stopping the flow of fuel when such engines are to stop.

Small internal combustion engines, such as those used to power lawn and garden equipment, have carburetors that receive fuel from a tank. The fuel is mixed that air in the carburetor and the mixture is supplied to the engine cylinder where it is ignited. During the exhaust stroke of the engine the combustion gases are forced from the cylinder through and through a muffler. The muffler becomes very hot due to the combustion gases.

When an operator desires to stop the engine a switch is closed that shorts the electrical ignition system to ground. This action prevents the spark plug from continuing to fire. However, the engine does not stop revolving immediately, but continues to revolve for several cycles. During this continued movement, the fuel mixture is drawn from the carburetor into the cylinder. Because the spark plug is not being fired, the unburnt fuel mixture is forced from the cylinder into the muffler. The muffler still is very hot causing ignition of the unburnt fuel mixture. This phenomenon is commonly called a backfire. Aside from producing a very loud noise, repeated backfires can destroy the muffler.

SUMMARY OF THE INVENTION

A general object of the present invention is to provide a mechanism for cutting off the supply of fuel to an internal combustion engine when the engine is being stopped. Such a mechanism prevents unburnt fuel from being expelled from the engine into the exhaust system.

This object is accomplished by placing a solenoid operated valve in the fuel line between the fuel supply and the engine cylinder. Preferably this valve is located in the bowl of the carburetor to decrease the flow of fuel to the venturi where the fuel mixes with air. The valve is normally in the open position due to a spring. When electricity is applied to the electromagnet coil of the solenoid, the valve moves into a closed position at which the fuel supply is shut-off entirely of significantly reduced so that a combustible air-fuel mixture is not formed in the venturi.

During normally operation of the engine, electric current from the ignition system flows through a primary winding of a transformer and a current is induced in a secondary winding. A capacitor is connected to the secondary winding and is charged by the current from that winding.

When an operator desires to shut off the engine the kill switch is closed. While this switch may short the ignition system to prevent the spark plug from firing, the kill switch also applies the voltage across the capacitor to the electromagnet coil of the solenoid. This action produces a magnetic field which closes the valve reducing the flow of gas through the carburetor and to the engine cylinder. This system has the advantage of reducing the air-fuel mixture from the carburetor to a noncombustible level. Thus as the stopping engine continues to rotate and the air-fuel mixture is expelled by the cylinder into a hot exhaust system, the mixture does not burn. As a consequence a back-fire does not occur in the stopping engine.

Another object is to provide such a fuel shut-off mechanism that does not require a battery for power.

A further object of the present invention is to provide a fuel cut-off mechanism that will fail in a position which will not disable operation of the engine.

DESCRIPTION OF THE PRESENT INVENTION

Figure 1:
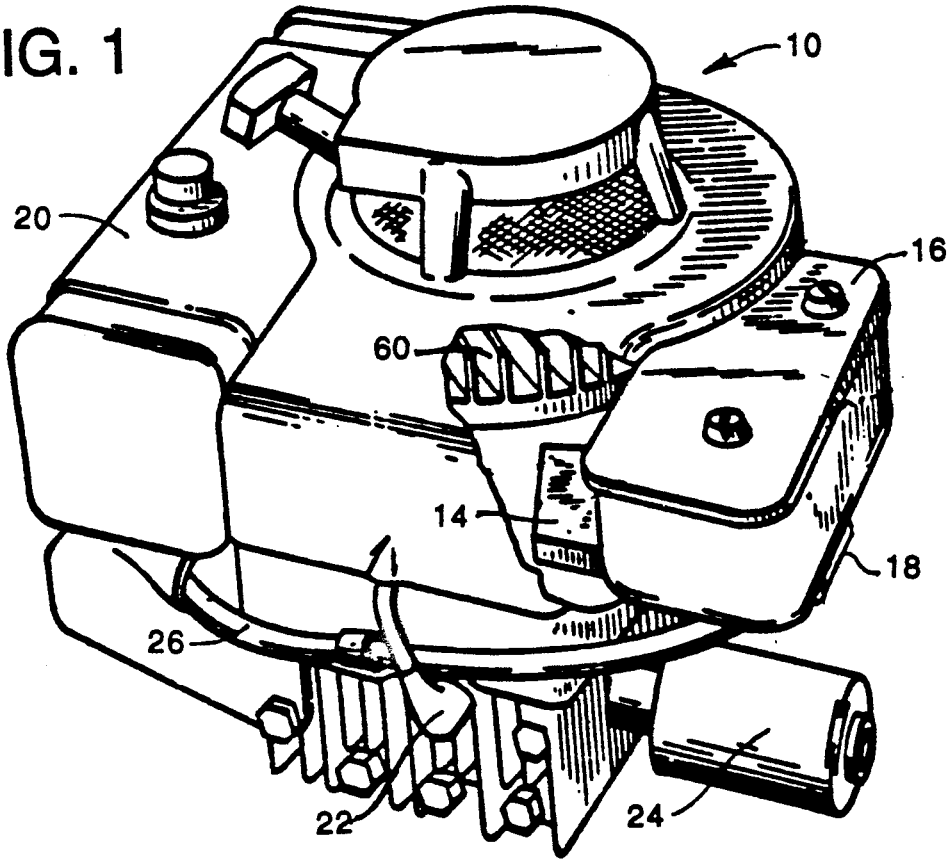
FIG. 1 is an isometric view of an single cylinder gasoline engine that incorporates a novel fuel shut-off mechanism.

FIG. 1 illustrates a single cylinder gasoline engine 10, such as the type commonly found on lawn mowers. Combustion air enters an inlet tube 14 and flows through an air cleaner 16 into the air inlet of a side-draft carburetor 18. Although the present invention is being described in the context of a side-draft carburetor, the novel concept can be applied to down-draft and up-draft carburetors, as well. The carburetor 18 receives gasoline from a tank 20 and mixes the fuel with the air flowing from the air cleaner 16. The air-fuel mixture passes from the carburetor 18 to the engine cylinder located behind spark plug 22. Combustion gases from the cylinder pass through a muffler 24.

Figure 2:
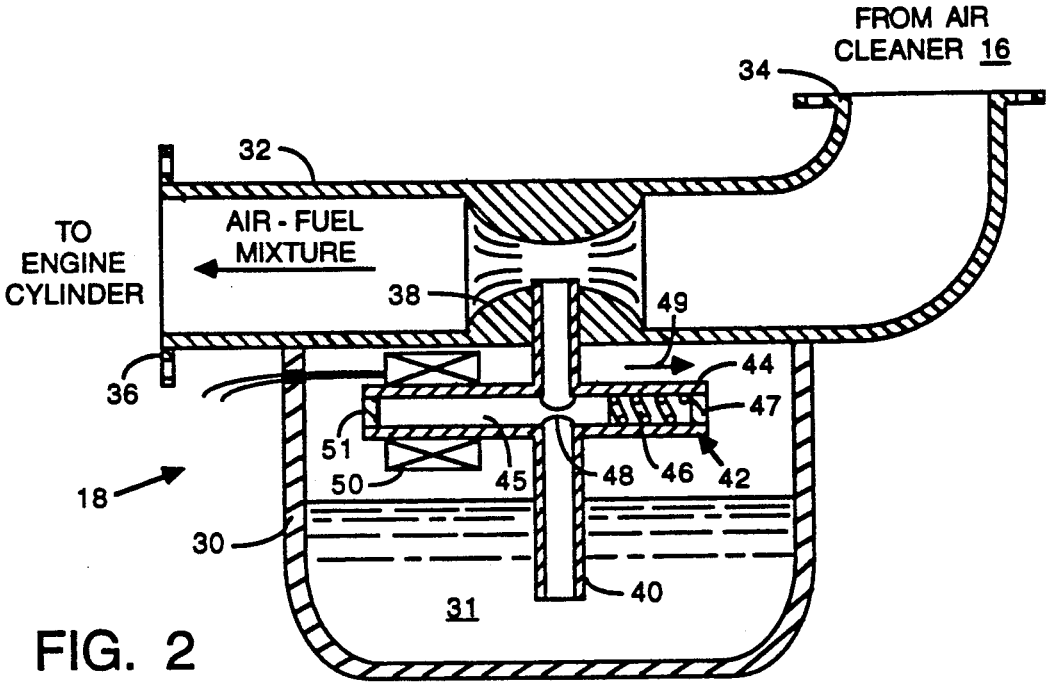
FIG. 2 is a cross sectional view of the carburetor in the engine.

With additional reference to FIG. 2, the carburetor 18 has a bowl 30 into which gasoline 31 flows from a hose 26 connected to the fuel tank 20. Across the upper end of the bowl 30 is a tube 32 having an inlet 34 attached to the air cleaner 16 and outlet 36 coupled to the engine cylinder. The carburetor tube 32 includes a conventional venturi 38 in which the inner diameter of the tube 32 is reduced significantly. A gasoline feed tube 40 extends vertically from the venturi 38 downward into the gasoline 31 within bowl 30. This fuel tube 40 has a solenoid valve 42 located above the level of the gasoline 31 in the bowl 30 and so that fuel residue will not build up on the valve.

The solenoid valve 42 includes a cross tube 44 in which a spool valve plunger 45 is located. The spool valve plunger 45 fabricated from a cylindrical rod of ferromagnetic material and has a smaller diameter portion 48. A compression spring 46 at one end 47 of the cross tube 44 biases the spool valve plunger 45 into a position at which the smaller diameter portion 48 is aligned with the gas feed tube 40, when the solenoid valve 42 is deenergized. Because portion 48 is smaller in diameter than the internal diameter of the cross tube 44, a passage exists at the intersection of tubes 40 and 44 enabling gasoline within the bowl 30 to be drawn upward through the gas feed tube 40 and into the venturi 38 due to the Bernoulli effect.

An electromagnet coil 50 is located around the other end 51 of the cross tube 44 that is remote from the spring 46. When energized, this electromagnet coil 50 produces a magnetic field which pushes the spool valve plunger 45 in the direction of arrow 49 compressing the spring 46. The spool valve plunger 45 slides a sufficient distance that the smaller diameter portion 48 lies outside of the gas feed tube 40. Instead, a full diameter section of the spool valve plunger 45 now is located within the gas feed tube 40 preventing any significant quantity of gas from being drawn through the feed tube into the venturi 38.

Figure 3:
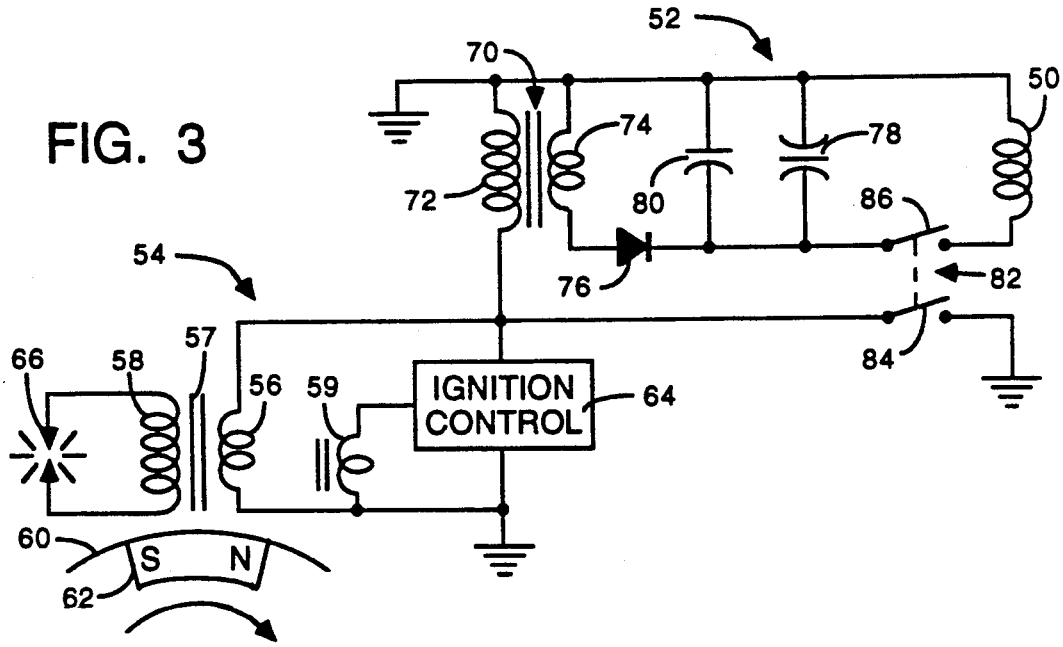
FIG. 3 is a schematic diagram of the electric circuit for controlling the solenoid valve in the carburetor.

FIG. 3 illustrates the control circuit 52 for energizing the solenoid valve 42. Circuit 52 receives power from the ignition system 54 for the engine 10. The ignition system 54 may be a capacitor discharge type similar to that described in U.S. Pat. No. Re. 31,837, which description is incorporated herein by reference. This type of ignition system has a primary coil 56 and a secondary coil 58 mounted on a ferromagnetic core 57 which is adjacent to a flywheel 60 of the engine 10. Also mounted on the core 57 is a charging coil 59. The primary coil 56 and the charging coil 59 are connected to an ignition control circuit 64.

A permanent magnet 62 is attached to the flywheel 60 so as to move past the three coils 56, 58 and 59 as the flywheel rotates. As the permanent magnet approaches the coils, an electric current is induced in the charging coil 59 which charges a capacitor within the ignition control circuit 64. As the permanent magnet 62 continues to move past the coil assembly, a voltage is induced across the primary coil 56 and triggers a switch within the ignition control circuit 64 which dumps the charge stored in the capacitor across the primary coil 56. This action produces a current pulse through the primary coil 56 inducing a high voltage across the secondary coil 58 and producing a spark in spark plug 66.

Part of the current, which in a conventional ignition system would flow through the primary coil 56, flows through a primary winding 72 of a transformer 70 in the solenoid valve control circuit 52. This current induces a current in a secondary winding 74 of the transformer 70 and produces approximately five volts across the secondary winding 72. The secondary current is rectified by diode 76 to charge a 0.47 Farad storage capacitor 78 connected in series with the diode between the terminals of the secondary winding 74 of transformer 70. A smaller 0.33 microfarad filter capacitor 80 is connected in parallel with the larger capacitor 78.

With reference to FIGS. 2 and 3, when the engine 10 is started, the spring 46 within the solenoid valve assembly 42 pushes the spool valve plunger 45 into a position in which gas can flow past the smaller diameter portion 48 into the venturi air stream through the carburetor 18. Electricity is not required to hold the valve in this position during engine starting and normal running. This is a key feature since many small gasoline engines do not utilize a battery or other source of power for starting. Thus upon commencement of engine operation, a source of electricity is not required as solenoid valve is in the normally open position. In addition, should the valve control circuit fail, the spool valve plunger 45 will fail in the normally open position allowing continued operation of the engine. Furthermore, the spool valve plunger 45 does not require a seat, against which the valve can stick in the closed position when the engine stands idle for a prolonged period.

Once the engine 10 reaches a normal running speed, pulses from the ignition system 54 applied to the transformer 70 gradually charge capacitor 78. The transformer must not load down the primary winding 56 of the ignition control circuit 54 to a degree that the spark plug 66 does not fire. This is accomplished by designing the valve control circuit 52 so that, depending upon the speed of the engine, it takes two to seven minutes before the charge on the storage capacitor 78 reaches three volts. The length of this charging period is acceptable as the solenoid valve 42 is energized only while the engine 10 is stopping, which typically does not occur for many more minutes after the engine has started. A three volt charge on the capacitor can energize the solenoid coil 50 for approximately twenty seconds which is longer than the typical stopping interval of the engine 10. Continued operation of the engine eventually fully charges the storage capacitor 78 to about five volts. At that level the solenoid valve 42 will remain energized for a longer period of time. As will be apparent, the charge on storage capacitor 78 optimally should be sufficient to energize the solenoid valve 42 from when engine shut-off commences until the engine stops rotating.

When it is desired to shut off the engine 10, the operator closes a kill switch 82. Switch 82 is a double-pole, single-throw type having a first set of contacts 84 which connect the ignition circuit output to ground as is conventionally done to stop small gasoline engines. A second set of contacts 86 of the kill switch 82 connect the electromagnet coil 50 of the solenoid valve 42 across the storage capacitor 78. This action causes current to flow from the storage capacitor 78 through the coil 50 producing a magnetic field which pushes the spool valve plunger 45 against spring 46 a sufficient distance so that the spool valve plunger blocks gas from flowing through the feed tube 40 in the venturi 38. This action either cuts off the flow of gas to the venturi or significantly leans the air-fuel mixture. For example, an air-fuel mixture of 150 to 1 or greater is sufficient to prevent backfiring while the engine is stopping.

Immediately after the closure of the kill switch 82, the engine 10 continues to turn due to inertia. Thus, the cylinder continues drawing air through the carburetor 18 and expelling the air through the muffler 24. Since the air-fuel mixture drawn from the carburetor 18 into the cylinder and forced out into the muffler is extremely lean because of the closure of the solenoid valve 42, that mixture will not burn upon contact with the hot muffler 24. Thus, the action of the solenoid valve 42 prevents a backfire from occurring.

The charge on the storage capacitor 78 is sufficient to maintain the solenoid valve 42 energized in the closed state for a sufficient period of time so that the engine will come to rest before the valve reopens. By the time that the charge on capacitor 78 drops to a point where the solenoid coil 50 is no longer energized and the spring 48 returns the spool valve plunger 45 into the open position illustrated in FIG. 2, the engine will have stopped rotating and will no longer draw an air-fuel mixture from the carburetor. Thus, the quiescent state of the solenoid valve will be in the open position enabling the engine to be restarted without the application of any electricity to the solenoid valve.

The present system offers several advantages over other types of fuel shut-off mechanisms. First of all, the spool valve plunger 45 does not have a seat against which a valve surface rests wherein it can become stuck during a long period of non-use. In addition, the valve is biased by the spring 46 into a normally open position, thereby not requiring electricity to open the valve which would not be generated significantly during engine cranking. Thus should a failure of the shut-off system occur, it is most likely that the valve 42 will fail in the open position. As a consequence, failure of the valve will not render the engine inoperable.

The invention being claimed is:

1. In an internal combustion engine having an ignition system for igniting fuel in a cylinder, the improvement comprising:

a valve through which the fuel flows between a fuel source and the cylinder;

an electromagnetic coil which when energized closes said valve; an electricity generating mechanism driven by the engine;

a capacitor coupled to said electricity generating mechanism to store electricity while the engine is running; and a kill switch that is closed to shut off the engine and when closed coupling said capacitor to said electromagnetic coil which thereby activates said valve to block fuel from flowing to the engine.

2. The fuel control system as recited in claim 1 wherein said kill switch has a first set of contacts which when closed provide a conductive path between said capacitor and said electromagnetic coil, and a second set of contacts mechanically coupled to the first set of contacts and electrically connected to prevent the ignition system from igniting fuel in the cylinder when the second set of contacts is closed.

3. In an internal combustion engine having an ignition system for igniting fuel in a cylinder, a fuel control system comprising:

a transformer having a primary winding connected to an ignition coil of the ignition system, and having a secondary winding;

a storage capacitor coupled to the secondary winding of said transformer;

a normally open solenoid valve connected in a fuel path through which the fuel flows to the cylinder;

a switch coupling said solenoid valve to said storage capacitor, said switch being closed when the engine is to stop thereby causing said solenoid valve to reduce an amount of fuel flowing to the cylinder.

4. The fuel control system as recited in claim 3 further comprising a diode coupling the secondary winding of said transformer to said storage capacitor.

5. The fuel control system as recited in claim 3 further comprising a filter capacitor connected in parallel with said storage capacitor.

6. The fuel control system as recited in claim 3 wherein said solenoid valve comprises:

a feed tube through which fuel can flow;

a cross tube communicating transversely with said feed tube;

a spool valve plunger of ferromagnetic material slideably located within said valve tube, and having a first position in which fuel can flow through said feed tube and a second position in which less fuel can flow through said feed tube than when the spool valve plunger is in the first position;

a spring which biases said spool valve plunger into the first position; and an coil which when energized by an electric current produces an electromagnetic field that drives said spool valve plunger into the second position.

7. In an internal combustion engine, the apparatus comprising:

a magnet attached to a member driven by the engine;

a coil assembly for generating electricity as the magnet passes near to said coil assembly;

a carburetor having a bowl for fuel, a venturi and a tube for carrying fuel from the bowl to the venturi, and further having a normally open solenoid valve connected to the tube to control a flow of fuel through the tube;

a transformer having a primary winding connected to the coil assembly, and having a secondary winding;

a diode;

a storage capacitor coupled in series with said diode across the secondary winding of said transformer; and a switch coupling the solenoid valve to said storage capacitor, said switch being closed to apply electricity to said solenoid valve which causes said solenoid valve to reduce an amount of fuel flowing through the tube.

8. The fuel control system as recited in claim 7 wherein the solenoid valve comprises:

a spool valve plunger of ferromagnetic material slideably located transverse to the tube, and having a first position in which fuel can flow through the tube and a second position in which less fuel can flow through the tube than when the spool valve plunger is in the first position;

a spring which biases the spool valve plunger into the first position; and an coil which when energized by an electric current produces an electromagnetic field that drives the spool valve plunger into the second position.

* * * * *